United States Patent [19]

Calamani et al.

[11] Patent Number: 4,598,656

[45] Date of Patent: Jul. 8, 1986

[54] DEVICE FOR THE TRANSFER OF COLLANTS AND THE LIKE TO A RELEVANT SEWING MACHINE AND DRAWING DEVICE

[75] Inventors: Sergio Calamani, Segrate; Eugenio Turri, Milan, both of Italy

[73] Assignee: Savio & C. S.p.A., Milan, Italy

[21] Appl. No.: 504,164

[22] Filed: Jun. 14, 1983

[30] Foreign Application Priority Data

Jun. 28, 1982 [IT] Italy ..... 22075 A/82

[51] Int. Cl.[4] ..... D05B 21/00

[52] U.S. Cl. ..... 112/121.12; 112/121.15

[58] Field of Search ..... 112/121.15, 121.12, 112/121.11; 223/42, 43

[56] References Cited

U.S. PATENT DOCUMENTS 3,916,808 11/1975 Cassinelli ..... 112/166 X 4,196,681 4/1980 Chietti ..... 112/121.15

4,364,320 12/1982 Nakhle et al. ..... 112/121.15 X 4,519,327 5/1985 Selvi ..... 112/121.15

*Primary Examiner*—H. Hampton Hunter

*Attorney, Agent, or Firm*—Oblon, Fisher, Spivak, McClelland & Maier

[57] ABSTRACT

The invention relates to a device for automatically supplying tubular fabrics to a machine providing for pairing, cutting and sewing thereof to partially form such articles as pantyhose, drawers or the like. The partially formed article then transferred keeping the inlet portion or waist thereof correctly open, from the sewing machine to a station where a stripping device is inserted in the inlet portion or waist to strip the partially formed pantyhose from the subject device and to carry the same to a machine where the partially formed pantyhose are subjected to a successive processing operation.

3 Claims, 9 Drawing Figures

9
10
11
12
15
6
15
16
19
17
8
13
15
18
19
14

25
26
20
C
8
III
8
D
60
30
3
4
2
21
6
5
40
6
8
A
30

25
III
26
23
20
5
27

24
33
21
22

DEVICE FOR THE TRANSFER OF COLLANTS AND THE LIKE TO A RELEVANT SEWING MACHINE AND DRAWING DEVICE

FIELD OF THE INVENTION

This invention relates to a device for the transfer of tubular fabrics and to a pantyhose sewing machine and the subsequent transfer of the partially formed pantyhose for further processing.

BACKGROUND OF THE INVENTION

It is well known that pantyhose or legging drawers are obtained by special sewing machines having elongate arms with brackets sliding there along and having textile tubular elements (or pantyhose leggings) superimposed thereon. The brackets are urged or pressed against one another to clamp or block the fabric interposed therebetween. Subsequently the fabric is longitudinally cut and sewn to couple the two tubular elements to each other and thereby provide for pantyhose formation. The pantyhose are removed from the sewing machine after the two brackets have been moved away from each other.

Special sewing machines of this type are well known and are described, for example, in U.S. Pat. No. 3,916,808, issued Nov. 4, 1975, to Cassinelli.

It is also well known that pantyhose or drawers obtained as above mentioned have to be sometimes subjected to subsequent processings or operations. For example, it often occurs that the central pantyhose portion or "astride" portion has to be backed by applying and sewing to the interior thereof as backing a block piece of textile material.

Automatic machines have been developed, such as that disclosed in the English Pat. No. 2,001,238A, which provide for positioning and sewing the backing block piece on the pantyhose. To this end, the pantyhose must be turned inside out and laid on a supporting body.

Machines are also known, such as that disclosed in the U.S. Pat. No. 4,196,681, issued Apr. 8, 1980, to Giovanni Chietti, having supports on which an operator places the opening or inlet portion of a tubular element, after which machine then transfer the element while turning it inside out onto the supporting body of a machine carrying out a subsequent processing or operation.

The above mentioned operative steps are difficult and time consuming. Each pair of pantyhose, after being sewn, must be removed from the forming machine and then manually inserted on the machine support for transfer to the block piece applying machine.

OBJECTS OF THE INVENTION

It is the primary object of the present invention to provide a tubular fabric to a machine on which pantyhose are shaped feeding the machine providing for collant shaping and sewn, for then stripping the partially formed pantyhose thus obtained and transferring the same, keeping the waist or opening thereof correctly open and laid out, to a station where a transport device is inserted in said opening or inlet portion, drawing the partially formed pantyhose away and in turn transferring the same, turned inside out, onto a machine which applies the reinforcement block pieces thereto.

It is a further object of the present invention to provide such a device which is of a very simple and inexpensive structure.

It is still a further object of the present invention to provide such a device which does not require any modification to the usual machines for pantyhose formation and the usual machines for application of the reinforcement or backing block pieces.

SUMMARY OF THE INVENTION

These and still further objects are achieved by a device comprising at least one frame having mounted thereon two pairs of elongate brackets in side by side relationship to each other; members for moving one bracket of each pair to and respectively away from a corresponding bracket of the other pair; members for longitudinally translating said pairs of brackets by forward and backward motion; and means for moving said frame so as to position said pairs of brackets in at least two different stations. At one of the two different stations two corresponding brackets of the two pairs are urged or pressed on each other, while the other two brackets are moved away from each other. At this station, while the two pairs of brackets remain at such positions they are longitudinally moved to and fro. The two brackets of one pair of brackets are then moved away from the brackets of the other pair of brackets associated therewith by a distance sufficient for stretching or laying out the inlet portion or waist of a partially formed pair of pantyhose carried by the brackets as the brackets are moved to the second station.

In order that the structure and features of the device may be more clearly understood, an embodiment thereof will now be described as by way of an unrestrictive example with reference to the accompanying drawings.

DETAILED DESCRIPTION OF THE PRESENTLY PREFERRED EMBODIMENT

A device according to the invention comprises a fixed frame 1 having mounted thereon an elongate shaft 2. The elongated shaft 2 is rotatably driven by intermittent motion and according to rotational excursions of 90° by a geared motor 3 coupled to a device 4 providing for intermittency of the shaft movement.

Figure 3:
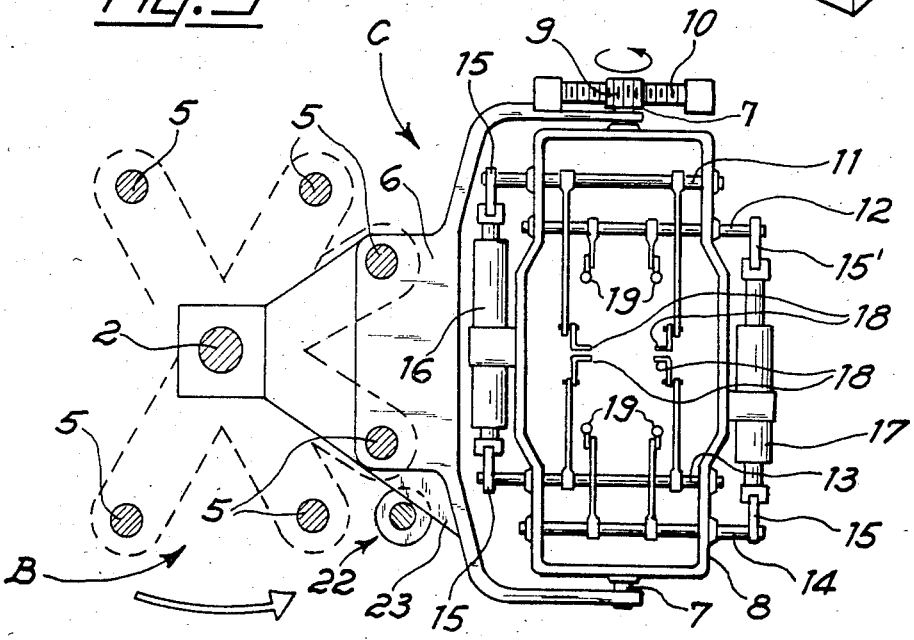
FIG. 3 is an enlarged fragmentary sectional view taken along line III—III of FIG. 2.

Integral with the shaft 2 there is a metal cage comprising a plurality (in this case eight) of longitudinal parallel bars 5, of which two have been for the sake of simplicity omitted in FIG. 3. Each pair of adjacent bars 5 have mounted and slidable thereon a slide 6. Each slide 6 supports a cage 8 by means of two coaxial pins 7. A pinion 9 is keyed to one of said pins 7 and engages with a rack-shaped surface of the stem 10 of a hydraulic or pneumatic piston, not shown for the sake of simplicity. Therefore, the displacement of the stem 10 causes the rotation of the associated pin 7 and thus of the cage 8 in one direction or the other.

Figure 4:
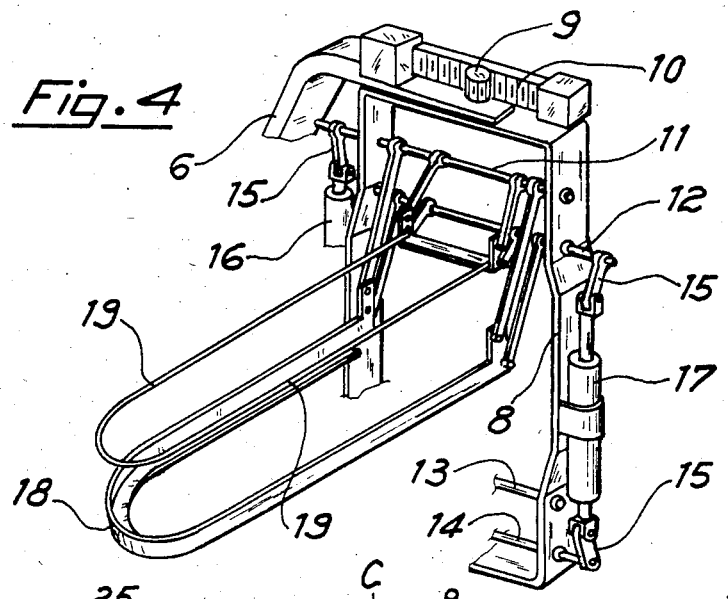
FIG. 4 is an enlarged fragmentary perspective view of the movable brackets forming part of the device according to the invention.

Four rotatable spindles 11, 12, 13 and 14 are mounted on each cage 8. The rotatable spindles 11 and 13 and the rotatable spindles 12 and 14 are connected, respectively, by articulated connecting rods 15 and 15' and the ends of the stems and bottoms of two hydraulic or pneumatic cylinders 16 and 17 of the double piston and stem type. The actuation of the cylinders 16 causes movement near or away from each other for two elongate brackets 18. Similarly, the actuation of the cylinder 17 causes movement near or away from each other for two elongate brackets 19, while are smaller than the elongate brackets 18. Only one pair of brackets 18 and 19 have been drawn for the sake of simplicity in FIG. 4. The brackets 18 and 19 are suspended by a parallelogram system to the rotable spindles 11–14. The supporting parallelograms for brackets 18 are rotatably bonded to spindles 11 and 13, respectively, while the supporting parallelograms for brackets 19 are rotatably bonded to spindles 12 and 14, respectively.

Laterally of the cage formed by the bars 5, a stem 20 extends and has mounted thereon a hydraulic or pneumatic cylinder 21. The cylinder 21 has an annular recess 22 in which, during the rotational movement of shaft 2, a shaped plate 23 forming part of each slide 6 inserts and translates.

Figure 1:
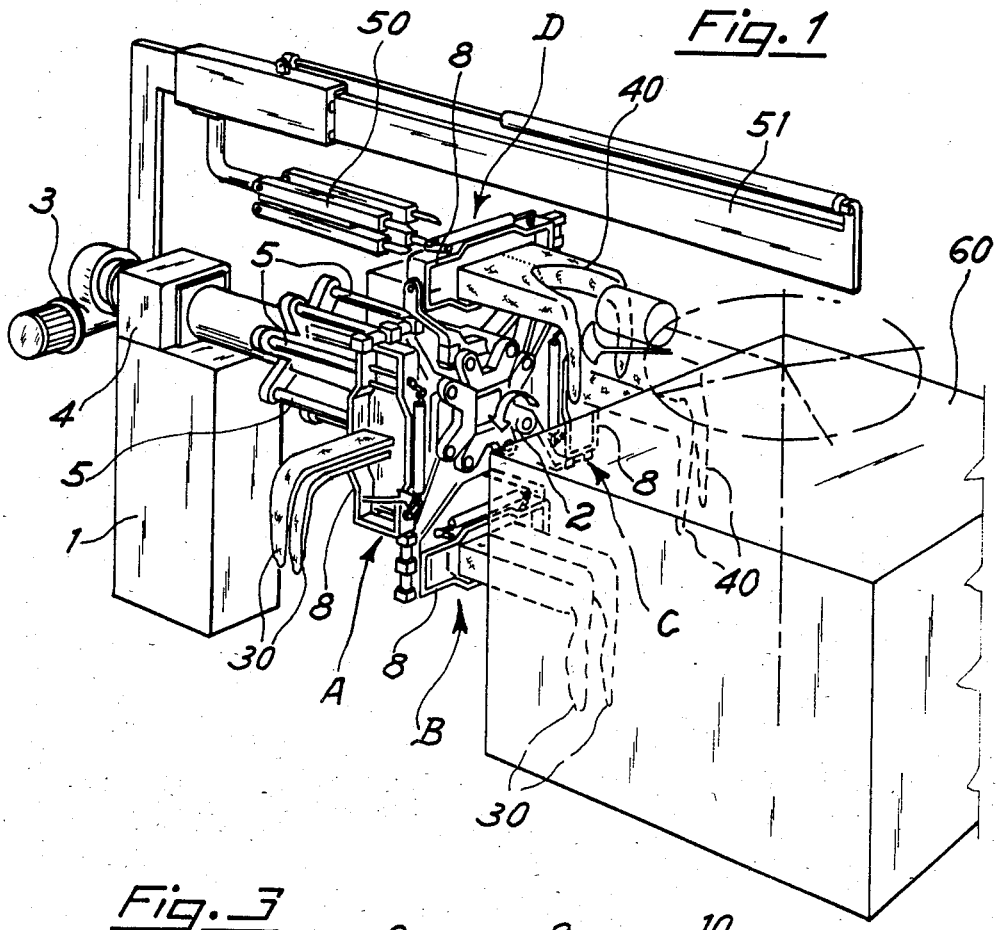
FIG. 1 is a perspective view of the device as coupled to a sewing machine for a pantyhose formation and a stripping and transferring device for transferring the partially formed pantyhose to aother machine.
Figure 2:
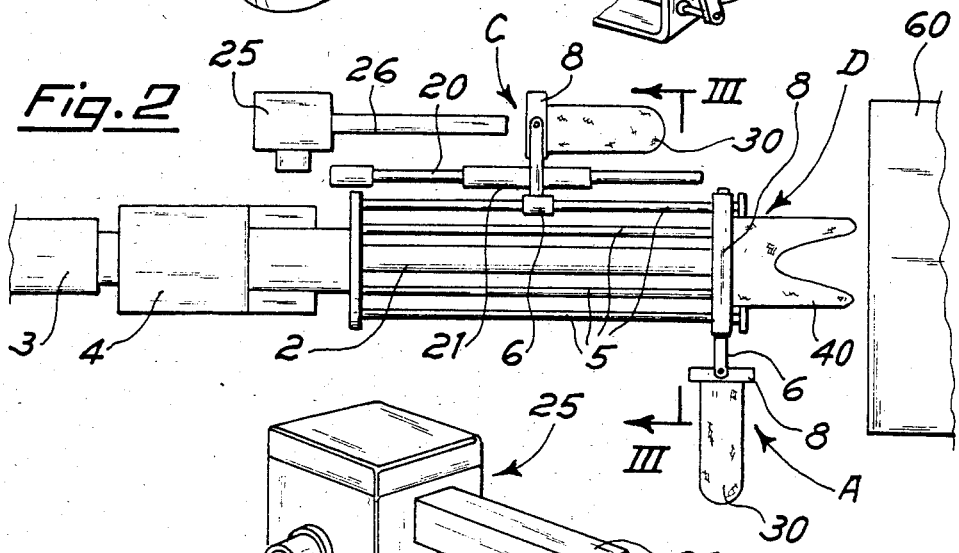
FIG. 2 is a schematic top view of the device according to the present invention.
Figure 5:
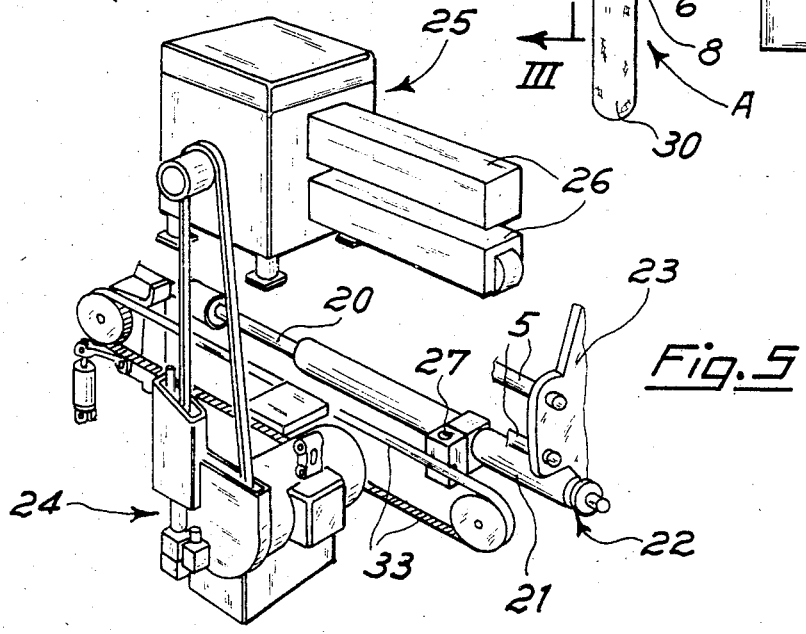
FIG. 5 is a view showing a detail of the device as juxtaposed to a sewing machine.

The translation of the plate 23 occurs when the cylinder 21 is fully displaced to the right as seen in FIGS. 1, 2 and 5. Laterally of the cylinder 21, a toothed belt 33 is rotatably driven by a motor or drive unit 24 which also operates a pantyhose sewing machine 25 located laterally of the device according to this invention. The pantyhose sewing machine 25 is per se well known. For example, it may be of the type described in U.S. Pat. No. 3,916,808, issued Nov. 4, 1975, to Cassinelli. Such a sewing machine comprises two elongate prismatic arms 26, between which provision is made for fabric cutting members and a sewing unit for tubular fabric. As such a machine is well known, it will not be further described herein.

The cylinder 21 has mounted thereon a pliers assembly 27 with movable elements, not shown, that can be electrically, pneumatically, or otherwise actuated. In any event, the movable elements of the pliers assembly 27 can be pressed together on the toothed belt 33 (fixing the cylinder 21 thereto) or remain away therefrom.

As above mentioned, in the case of the embodiment shown on the drawings, four distinct slides 6 are provided, and the shaft 2 is moved stepwise throught 90°, thus displacing each slide to four successive stations about the shaft 2, denoted by letters A–D.

Figure 6:
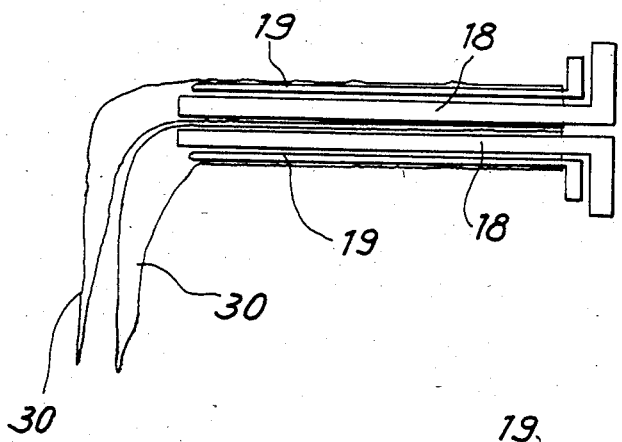
FIGS. 6 to 9 are views schematically showing the different positions that the movable brackets forming part of the device according to the invention take during operation.
Figure 7:
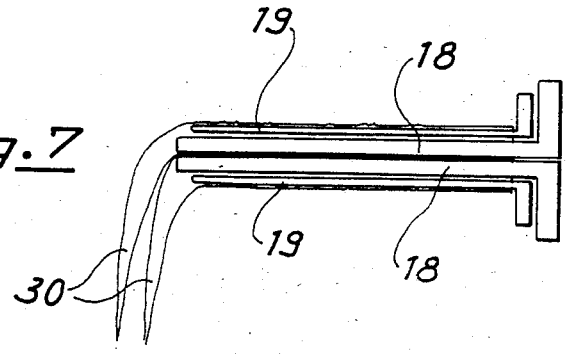

Let us first consider the station A, at which the brackets 18 and 19 of the cage 8 located at the station A are horizontal and outwardly facing (FIGS. 1 and 2). At this station, the two brackets 18 are slightly spaced apart from each other. Similarly, the brackets 19 are spaced apart from each other (FIG. 6). For an operator sitting down in front of the device, it will thus be easy to insert on each pair of brackets 18 and 19 a tubular element 30 in the shape of a woman's leg and foot long stocking. As soon as this manual operation is completed, the two brackets 18 are urged or pressed towards each other, clamping the two tubular elements 30 therebetween (FIG. 7).

Figure 8:
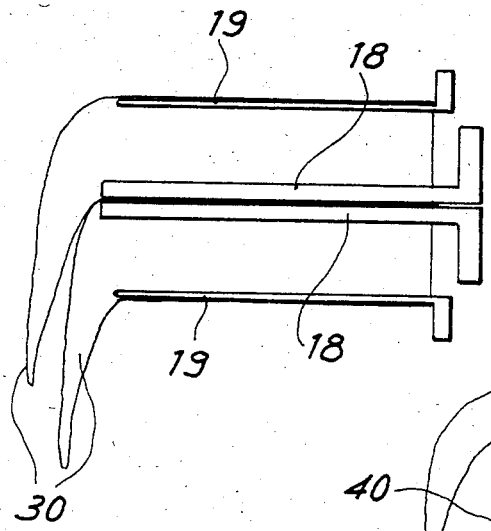

Now, the cage 8 is rotated through 90° on the pins 7, while the shaft 2 also rotates through 90°, so that the brackets 18 are moved to the position shown as station B in FIG. 1. At the same time, the brackets 19 open the tubular elements wide apart (FIG. 8).

Then, the shaft 2 is rotated through a further 90° to reach the station C.

On reaching the station C, the cage 8 is positioned in front of the arms 26 of the tubular element cutting and sewing machine 25. During the rotation of the shaft 2 in passing from station B to station C, the plate 23 is inserted in the groove 22 of piston 21.

The piston 21 is now operated and the slide 6 is rapidly displaced to the left, as seen in FIGS. 1, 2, 4 and 5, causing the two arms 26 to penetrate into the cavity of the tubular elements 30. During this operation, the tubular elements 30 are kept at the open position, as above mentioned.

Figure 9:
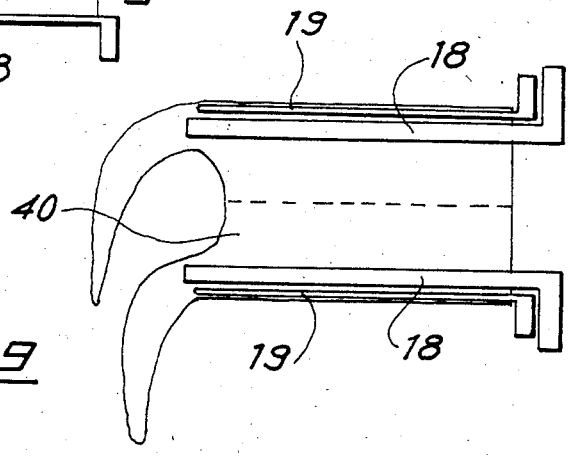

As soon as said slide 6 has reached the leftward end of its stroke, the pliers assembly 27 is caused to grip the belt 33. Thus, movement of the belt 33 in synchronism or timing relationship with the movements of the machine 25 causes the piston 21 and the slide 6 to return slowly to the right. During this displacement, the machine 25 cuts the two tubular fabrics 30 at the zone between the two brackets 18 and sews the two tubular fabrics to each other at the cut zone. Accordingly, the two tubular fabrics 30 take the configuration of a partially formed pantyhose which, for the sake of clarity, has been denoted by reference numeral 40 in FIGS. 1, 2 and 9.

As soon as the slide 6 has moved back to the right end of the bars 5, the brackets 18 are moved away from each other to positions adjacent the brackets 19 (FIG. 8). In this position, the two pairs of brackets 18 and 19 hold well open and stretched out the inlet portion or waist of the partially formed pantyhose 40.

The further rotation through 90° of the shaft 2 causes the plate 23 to become disengaged from the groove 22. At the same time the pairs of brackets 18 and 19 (still widely spread apart from each other) carry the partially formed pantyhose 40 with its inlet portion correctly open to the upper portion of the device that is, to the station D. At the station D, a device 50, movable on a frame 51, is inserted into the partially formed pantyhose 40. By rightward movement (as seen in FIG. 1), the device 50 removes the partially formed pantyhose 40 from the brackets 18 and 19 and transfers it, while turning it inside out to a rigid support on a machine 60 provided for the application and sewing of a backing block piece internally of the pantyhose astride portion.

The device 50 is not described herein since it is per se well known. For example, the device 50 may be of the type disclosed in commonly assigned U.S. Patent Application Ser. No. 398,443 filed on July 14, 1982. The block piece applying machine 60 is also per se well known as described, for example, in the English Pat. No. 2,001,238A.

The operating modalities for the several movable parts of the device shown are not described herein, since they are obvious and readily obtainable by those skilled in the art.

The primary feature of the described device is that of automatically enabling the supply of the two tubular elements 30 to the sewing machine, along with the feature that, upon completion of sewing operations, a partially formed pantyhose is completely opened and transferred, with its inlet portion correctly open, to a station where it is automatically transferred to another machine.

What is claimed is:

1. A device for the transfer of tubular fabrics to a pantyhose sewing machine and for the subsequent transfer of the partially formed pantyhose for further processing, said device comprising:

(a) a frame;

(b) first, second, third, and fourth elongate brackets mounted on said frame in side-by-side relationship to each other;

(c) first means for moving said first, second, third, and fourth elongate brackets sequentially through the following positions:

(i) a first position in which all four elongate brackets are slightly spaced apart from each other, are horizontal, and project outwardly from said frame, whereby, during use of the device, an operator can slide a first tubular element over said first and third elongate brackets and a second tubular element over said second and fourth elongate brackets; then (ii) a second position in which said first and second elongate brackets are pressed together, whereby, during use of the device, the first and second tubular elements are both clamped between said first and second elongate brackets; then (iii) a third position in which said third elongate bracket is moved away from said first elongate bracket and said fourth elongate bracket is moved away from said second elongate bracket, whereby, during use of the device, the first and second tubular elements are opened wide, in which position the arms of a pantyhose sewing machine can penetrate into each tubular element, cut each tubular element at the zone between said first and second elongate brackets, and sew the first and second tubular elements to each other at the cut zone to form a partially formed panty hose; and then (iv) a fourth position in which said first elongate bracket is moved adjacent to said third elongate bracket and said second elongate bracket is moved adjacent to said fourth elongate bracket, whereby, during use of the device, said elongate brackets hold the partially formed pantyhose well open with the waist portion of the partially formed pantyhose stretched open so that another device can enter the open waist portion of the partially formed pantyhose and slide it off said elongate brackets for further processing.

2. A device as recited in claim 1 wherein:

(a) said first means comprise:

(i) a rigid structure mounted on said frame, said rigid structure being movable between or among at least two different stations;

(ii) at least one slide longitudinally translatable on said rigid structure; and (iii) a cage mounted on said at least one slide and rotatable on an axis which is at least substantially perpendicular to the direction of motion of said at least one slide, said cage supporting said elongate brackets, and (b) said first means causes said slide to translate first in one direction and then in the other direction while said rigid structure is in a first one of its two different stations.

3. A device as recited in claim 2 wherein:

(a) said rigid structure is mounted on a rotary shaft;

(b) the rotation of said rotary shaft carries said elongate brackets to four distinct stations;

(c) in one of said four distinct stations, said elongate brackets are operatively juxtaposed to a pantyhose sewing machine; and (d) in another one of said four distinct stations, said elongate brackets are spaced from each other to maintain a partially formed pair of pantyhose in an open condition and said elongate brackets are operatively juxtaposed to a machine for stripping the partially formed pair of pantyhose from said elongate brackets and to transfer the partially formed pair of pantyhose for further processing.

* * * * *